US011846203B1

(12) United States Patent
Morris et al.

(10) Patent No.: US 11,846,203 B1
(45) Date of Patent: Dec. 19, 2023

(54) TURBINE NOZZLE WITH DUST TOLERANT IMPINGEMENT COOLING

(71) Applicant: HONEYWELL INTERNATIONAL INC., Charlotte, NC (US)

(72) Inventors: Mark Morris, Phoenix, AZ (US); Daniel Crites, Phoenix, AZ (US); Steven Whitaker, Phoenix, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 18/155,144

(22) Filed: Jan. 17, 2023

(51) Int. Cl.
*F01D 5/18* (2006.01)
*F01D 9/04* (2006.01)

(52) U.S. Cl.
CPC ..... *F01D 5/187* (2013.01); *F01D 9/041* (2013.01); *F05D 2250/711* (2013.01); *F05D 2250/712* (2013.01); *F05D 2260/201* (2013.01)

(58) Field of Classification Search
CPC .... F01D 5/187; F01D 9/041; F05D 2250/711; F05D 2250/712; F05D 2260/201
See application file for complete search history.

(56) References Cited

U.S. PATENT DOCUMENTS 7,837,441 B2 11/2010 Spangler et al.
8,161,752 B2 4/2012 Yankowich et al.
10,309,228 B2 6/2019 Dutta et al.
10,577,954 B2 3/2020 Kington et al.
10,704,396 B2 7/2020 Loricco et al.
10,995,635 B2 5/2021 Lamson
2009/0317258 A1 12/2009 Tibbott et al.
2011/0232299 A1 9/2011 Stryapunin et al.
2015/0082808 A1* 3/2015 Crites ..... F01D 5/187 415/115
2018/0274377 A1* 9/2018 Kington ..... F01D 9/065
2019/0017392 A1 1/2019 Dutta et al.
2021/0246797 A1 8/2021 Galoul et al.

* cited by examiner

*Primary Examiner* — Jacob M Amick
*Assistant Examiner* — Ruben Picon-Feliciano
(74) *Attorney, Agent, or Firm* — LORENZ & KOPF, LLP

(57) ABSTRACT

A turbine vane airfoil and a turbine nozzle that includes the turbine vane airfoil. The turbine vane airfoil includes an airfoil defining a chamber proximate a surface, and an impingement tube. The impingement tube includes a first wall and a second wall. The first wall defines a plurality of first apertures, and each has a first upstream surface portion opposite a first downstream surface portion. The second wall defines a plurality of second apertures, and each has a second upstream surface portion opposite a second downstream surface portion. Each of the first apertures cooperate with a respective one of the second apertures to direct a cooling fluid onto the surface, and the first downstream surface portion of at least one of the first apertures includes a first point that is collinear with a second point of the second downstream surface portion of the respective one of the second apertures.

20 Claims, 13 Drawing Sheets

TURBINE NOZZLE WITH DUST TOLERANT IMPINGEMENT COOLING

TECHNICAL FIELD

The present disclosure generally relates to gas turbine engines, and more particularly relates to a turbine nozzle associated with a turbine of a gas turbine engine having a turbine vane airfoil with dust tolerant impingement cooling.

BACKGROUND

Gas turbine engines may be employed to power various devices. For example, a gas turbine engine may be employed to power a mobile platform, such as an aircraft. In certain operating environments, such as desert operating environments, the gas turbine engine may ingest fine sand and dust particles during operation. These ingested fine sand and dust particles may pass through portions of the gas turbine engine and may accumulate in stagnation regions of cooling circuits within turbine components, such as the airfoils of a turbine vane associated with a turbine nozzle. The accumulation of the fine sand and dust particles in the stagnation regions of the cooling circuits in the turbine components, such as the airfoil, may impede the cooling of the airfoil, which in turn, may reduce the life of the airfoil and the turbine nozzle leading to increased repair costs and downtime for the gas turbine engine.

Accordingly, it is desirable to provide a turbine nozzle with dust tolerant impingement cooling, which reduces the accumulation of fine sand and dust particles within turbine vane airfoils associated with the turbine nozzle, thereby increasing cooling of the turbine vane airfoils and the life of the turbine nozzle. Furthermore, other desirable features and characteristics of the present invention will become apparent from the subsequent detailed description and the appended claims, taken in conjunction with the accompanying drawings and the foregoing technical field and background.

SUMMARY

According to various embodiments, provided is a turbine vane airfoil for a turbine nozzle. The turbine vane airfoil includes an airfoil defining a chamber proximate a surface, and an impingement tube configured to be disposed in the chamber and configured to receive a cooling fluid. The impingement tube includes a first wall that is spaced apart from a second wall. The first wall defines a plurality of first apertures, and each of the plurality of first apertures has a first upstream surface portion opposite a first downstream surface portion in a flow direction of the cooling fluid into the impingement tube. The second wall defines a plurality of second apertures, and each of the plurality of second apertures has a second upstream surface portion opposite a second downstream surface portion. At least one of the plurality of first apertures has a first dimension between the first upstream surface portion and the first downstream surface portion that is greater than a second dimension between the second upstream surface portion and the second downstream surface portion of at least one of the plurality of second apertures. Each of the plurality of first apertures cooperate with a respective one of the plurality of second apertures to direct the cooling fluid onto the surface, and the first downstream surface portion of at least one of the plurality of first apertures includes a first point that is collinear with a second point of the second downstream surface portion of the respective one of the plurality of second apertures along a line, and the line is substantially parallel to a first centerline of the at least one of the plurality of first apertures.

The at least one of the plurality of second apertures includes a second centerline, the first centerline is offset from the second centerline and the first centerline is substantially parallel to the second centerline. Each of the plurality of first apertures has a first geometry that is the same as a second geometry of each of the plurality of second apertures. Each of the plurality of first apertures has a first geometry that is different than a second geometry of each of the plurality of second apertures. At least one of the plurality of first apertures includes at least one convex surface. The at least one convex surface is defined at the first upstream surface portion. The at least one convex surface is defined at the first downstream surface portion. The at least one convex surface includes a pair of convex surfaces, with a first one of the pair of convex surfaces defined at the first upstream surface portion and a second one of the pair of convex surfaces defined at the first downstream surface portion. At least one of the plurality of first apertures includes at least one concave surface. The at least one concave surface is defined at the first upstream surface portion. At least one of the plurality of first apertures further comprises a pair of opposing sidewalls defined by a pair of arcuate surfaces. At least one of the plurality of first apertures further comprises a pair of opposing sidewalls defined by a pair of concave surfaces. The first upstream surface portion is defined by at least a concave surface and a convex surface. The first wall is an inner wall of the impingement tube, the second wall is an outer wall of the impingement tube, and the second wall is positioned between the first wall and the surface. The surface is opposite a leading edge of the airfoil. The impingement tube includes a first tube body that includes the first wall, a second tube body that includes the second wall, the first tube body defines a plenum configured to receive the cooling fluid into the impingement tube, and the first tube body is coupled to the second tube body such that a tube chamber is defined between at least a portion of the first tube body and the second tube body.

Further provided is a turbine nozzle. The turbine nozzle includes a turbine vane airfoil including an airfoil defining a chamber proximate a surface, and an impingement tube configured to be disposed in the chamber. The impingement tube includes a first tube body including a first wall and a second tube body including a second wall. The first tube body defines a plenum configured to receive a cooling fluid. The first wall is spaced apart from the second wall, and the first wall defines a plurality of first apertures. Each of the plurality of first apertures has a first upstream surface portion opposite a first downstream surface portion in a flow direction of the cooling fluid into the first tube body. The second wall defines a plurality of second apertures, and each of the plurality of second apertures has a second upstream surface portion opposite a second downstream surface portion. At least one of the plurality of first apertures has a first dimension between the first upstream surface portion and the first downstream surface portion that is greater than a second dimension between the second upstream surface portion and the second downstream surface portion of at least one of the plurality of second apertures. Each of the plurality of first apertures cooperate with a respective one of the plurality of second apertures to direct the cooling fluid onto the surface. The first downstream surface portion of at least one of the plurality of first apertures includes a first point that is collinear with a second point of the second downstream surface portion of the respective one of the plurality of second apertures along a line and the line is substantially parallel to a first centerline of the at least one of the plurality of first apertures.

The at least one of the plurality of second apertures includes a second centerline, the first centerline is offset from the second centerline and the first centerline is substantially parallel to the second centerline. Each of the plurality of first apertures has a first geometry that is different than a second geometry of each of the plurality of second apertures. The first wall is an inner wall of the impingement tube, the second wall is an outer wall of the impingement tube, the second wall is positioned between the first wall and the surface, and the surface is opposite a leading edge of the airfoil.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
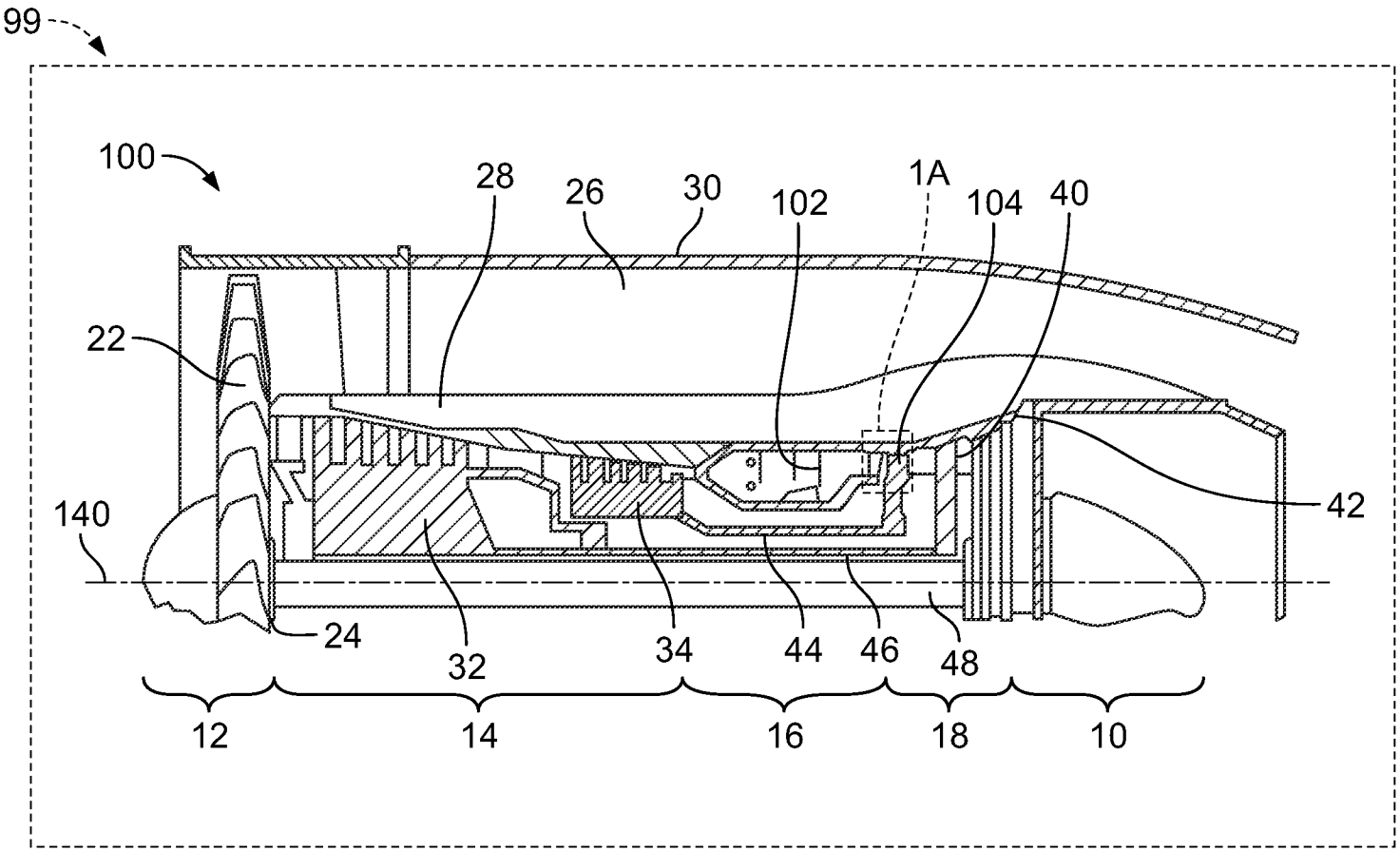
FIG. 1 is a schematic cross-sectional illustration of a gas turbine engine, which includes an exemplary high pressure turbine nozzle with dust tolerant impingement cooling in accordance with the various teachings of the present disclosure.

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the present disclosure may be practiced in conjunction with any type of component for a gas turbine engine that would benefit from dust tolerant impingement cooling and that the turbine vane airfoils associated with the turbine nozzle are merely one exemplary embodiment according to the present disclosure. Moreover, while the turbine nozzle is described herein as being used with a gas turbine engine onboard a mobile platform, such as a bus, motorcycle, train, motor vehicle, marine vessel, aircraft, rotorcraft and the like, the various teachings of the present disclosure can be used with a gas turbine engine on a stationary platform. Further, it should be noted that many alternative or additional functional relationships or physical connections may be present in an embodiment of the present disclosure. In addition, while the figures shown herein depict an example with certain arrangements of elements, additional intervening elements, devices, features, or components may be present in an actual embodiment. It should also be understood that the drawings are merely illustrative and may not be drawn to scale.

As used herein, the term "axial" refers to a direction that is generally parallel to or coincident with an axis of rotation, axis of symmetry, or centerline of a component or components. For example, in a cylinder or disc with a centerline and generally circular ends or opposing faces, the "axial" direction may refer to the direction that generally extends in parallel to the centerline between the opposite ends or faces. In certain instances, the term "axial" may be utilized with respect to components that are not cylindrical (or otherwise radially symmetric). For example, the "axial" direction for a rectangular housing containing a rotating shaft may be viewed as a direction that is generally parallel to or coincident with the rotational axis of the shaft. Furthermore, the term "radially" as used herein may refer to a direction or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominately in the respective nominal axial or radial direction. As used herein, the term "substantially" denotes within 10% to account for manufacturing tolerances.

With reference to FIG. 1, a partial, cross-sectional view of an exemplary gas turbine engine 100 is shown with the remaining portion of the gas turbine engine 100 being axisymmetric about a longitudinal axis 140, which also comprises an axis of rotation for the gas turbine engine 100. As will be discussed herein, the gas turbine engine 100 includes a turbine nozzle 200 (FIG. 1A), which has at least one turbine vane system or turbine vane airfoil 202 with dust tolerant impingement cooling. By providing the turbine vane airfoil 202 with dust tolerant impingement cooling, the accumulation of fine sand and dust particles within the turbine vane airfoil 202 is reduced, which improves a life of the turbine nozzle 200. It should be noted that while the turbine nozzle 200 and the turbine vane airfoil 202 are illustrated and described herein as being used with the gas turbine engine 100, which can be included with an auxiliary power unit, the turbine nozzle 200 and/or the turbine vane airfoil 202 can be employed with various types of engines, including, but not limited to, turbofan, turboprop, turboshaft, and turbojet engines, whether deployed onboard an aircraft, watercraft, or ground vehicle (e.g., a tank), included within industrial power generators, or utilized within another platform or application. In this example, the gas turbine engine 100 is employed within an aircraft 99.

In the example shown in FIG. 1, the gas turbine engine 100 includes a fan section 12, a compressor section 14, a combustor section 16, a turbine section 18, and an exhaust section 10. The fan section 12 includes a fan 22 mounted on a rotor 24 that draws air into the gas turbine engine 100 and accelerates it. A fraction of the accelerated air exhausted from the fan 22 is directed through an outer (or first) bypass duct 26 and the remaining fraction of air exhausted from the fan 22 is directed into the compressor section 14. The outer bypass duct 26 is generally defined by an inner casing 28 and an outer casing 30. In the embodiment of FIG. 1, the compressor section 14 includes an intermediate pressure compressor 32 and a high pressure compressor 34. However, in other embodiments, the number of compressors in the compressor section 14 may vary. In the depicted embodiment, the intermediate pressure compressor 32 and the high pressure compressor 34 sequentially raise the pressure of the air and direct a majority of the high pressure air into the combustor section 16. A fraction of the compressed air bypasses the combustor section 16 and is used to cool, among other components, turbine blades in the turbine section 18.

In the combustor section 16, which includes a combustor 102, the high pressure air is mixed with fuel, which is combusted. The high-temperature combustion air is directed into the turbine section 18. In this example, the turbine section 18 includes three turbines disposed in axial flow series, namely, a high pressure turbine 104, an intermediate pressure turbine 40, and a low pressure turbine 42. However, it will be appreciated that the number of turbines, and/or the configurations thereof, may vary. In this embodiment, the high-temperature air from the combustor section 16 is directed through the turbine nozzle 200 and expands through and rotates each turbine 104, 40, and 42. As the turbines 104, 40, and 42 rotate, each drives equipment in the gas turbine engine 100 via concentrically disposed shafts or spools. In one example, the high pressure turbine 104 drives the high pressure compressor 34 via a high pressure shaft 44, the intermediate pressure turbine 40 drives the intermediate pressure compressor 32 via an intermediate pressure shaft 46, and the low pressure turbine 42 drives the fan 22 via a low pressure shaft 48.

Figure 1A:
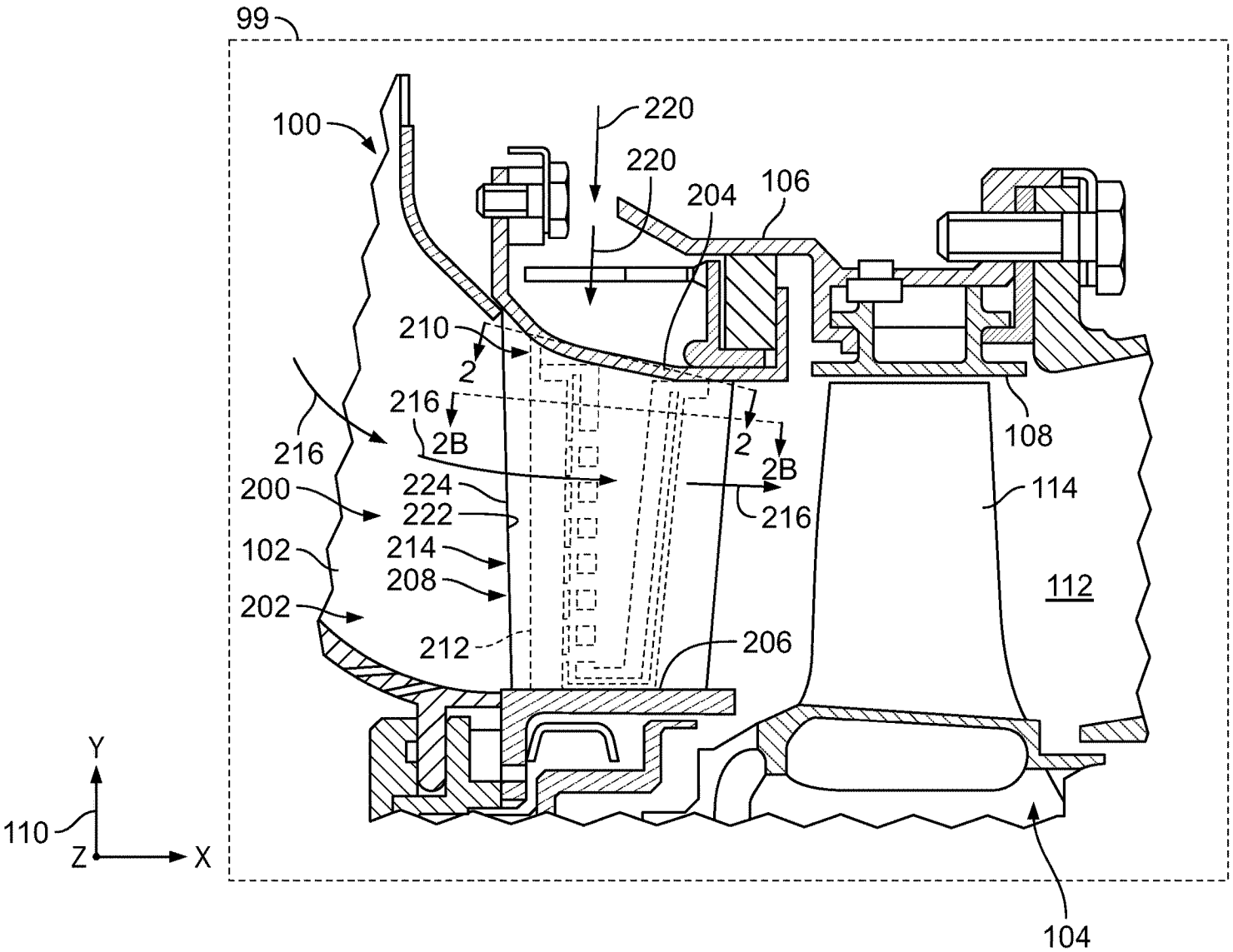
FIG. 1A is a schematic cross-sectional illustration of a portion of a turbine section of the gas turbine engine, taken at 1A of FIG. 1, which includes the exemplary high pressure turbine nozzle with a turbine vane airfoil having dust tolerant impingement cooling in accordance with the various teachings of the present disclosure.

With reference to FIG. 1A, a portion of the turbine section 18 is shown in greater detail. In this example, the gas turbine engine 100 includes the turbine nozzle 200, as illustrated in accordance with an exemplary embodiment. In this example, the turbine nozzle 200 is a high pressure turbine nozzle. In addition to the turbine nozzle 200, the illustrated portion of the gas turbine engine 100 further includes a downstream or outlet end of the combustor 102, the high pressure turbine 104, a surrounding turbine case 106, and a turbine shroud 108. The turbine nozzle 200, the outlet end of the combustor 102, the high pressure turbine 104, the turbine case 106 and the turbine shroud 108 are each generally axisymmetric about the centerline or rotational axis of the gas turbine engine 100, which is parallel to the X-axis identified by the coordinate legend 110. A core gas flow path 112 extends through the illustrated portions of the gas turbine engine 100 and is defined by the combustor 102, the turbine nozzle 200, the high pressure turbine 104, and the turbine shroud 108. During operation of the gas turbine engine 100, combustive gasses are discharged from the combustor 102 and progress along the core gas flow path 112. The turbine nozzle 200 is positioned immediately downstream of the combustor 102 and upstream of the high pressure turbine 104. The turbine nozzle 200 receives the hot, combustive gas flow discharged by the combustor 102. The turbine nozzle 200 meters, accelerates, and turns the combustive gas flow toward a plurality of turbine blades 114 associated with the high pressure turbine 104. After exiting the turbine nozzle 200, the combustive gas flow drives rotation of the high pressure turbine 104 and non-illustrated shaft or shafts associated with the gas turbine engine 100. This, in turn, drives the rotation of other non-illustrated components (e.g., a fan or compressor rotor) associated with the gas turbine engine 100 and provides power output, which may be extracted from the gas turbine engine 100 in different forms.

The turbine nozzle 200 includes an outer annular endwall 204 and an inner annular endwall 206, which are substantially concentric and radially spaced. The outer and inner annular endwalls 204, 206 bound inner and outer peripheries of the portion of the core gas flow path 112, which extends through the turbine nozzle 200. The turbine nozzle 200 also includes a number of the turbine vane airfoils 202, one of which can be seen in the cross-section of FIG. 1A. The turbine vane airfoils 202 are arranged in an annular array, which is located between the annular endwalls 204, 206. Each of the turbine vane airfoils 202 extends between the annular endwalls 204, 206 in a different radial direction similar to the spokes of a wheel; the term "radial direction" defined herein as a direction extending perpendicular to the centerline of the turbine nozzle 200 and the centerline or rotational axis of the gas turbine engine 100. Thus, the turbine vane airfoil 202 shown in FIG. 1A extends in a radial direction, which corresponds to the Y-axis of the coordinate legend 110. The axial direction is a direction perpendicular to the radial direction and parallel to the centerline of the turbine nozzle 200, and the axial direction corresponds to the X-axis of the coordinate legend 110. The Z-axis is perpendicular to the Y-axis and the X-axis. The turbine vane airfoil 202 is shown in a flattened or meridional state in the cross-sectional schematic of FIG. 1A.

As shown in phantom in FIG. 1, the turbine vane airfoil 202 includes an airfoil 208 and an impingement tube 210. As will be discussed, the impingement tube 210 provides dust tolerant impingement cooling for the airfoil 208 of the turbine vane airfoil 202, and thus, the turbine nozzle 200. In this example, the airfoil 208 includes an internal chamber 212 (FIG. 2), and the impingement tube 210 is inserted into the internal chamber 212 of the airfoil 208. Similar or identical impingement tubes are likewise inserted into the other non-illustrated airfoils 208 of turbine vane airfoils 202 associated with the turbine nozzle 200, which may be similar or identical to the illustrated turbine vane airfoil 202. Thus, the turbine nozzle 200 contains multiple impingement tubes 210, which are collectively arranged in an annular array that is substantially concentric with the centerline of the turbine nozzle 200. For simplicity, the following description will focus primarily on the illustrated turbine vane airfoil 202 shown in FIGS. 1A and 2, and the illustrated impingement tube 210 shown in FIGS. 1A-8; however, the following description is equally applicable to the other non-illustrated impingement tubes and turbine vane airfoils included within the turbine nozzle 200.

Figure 2:
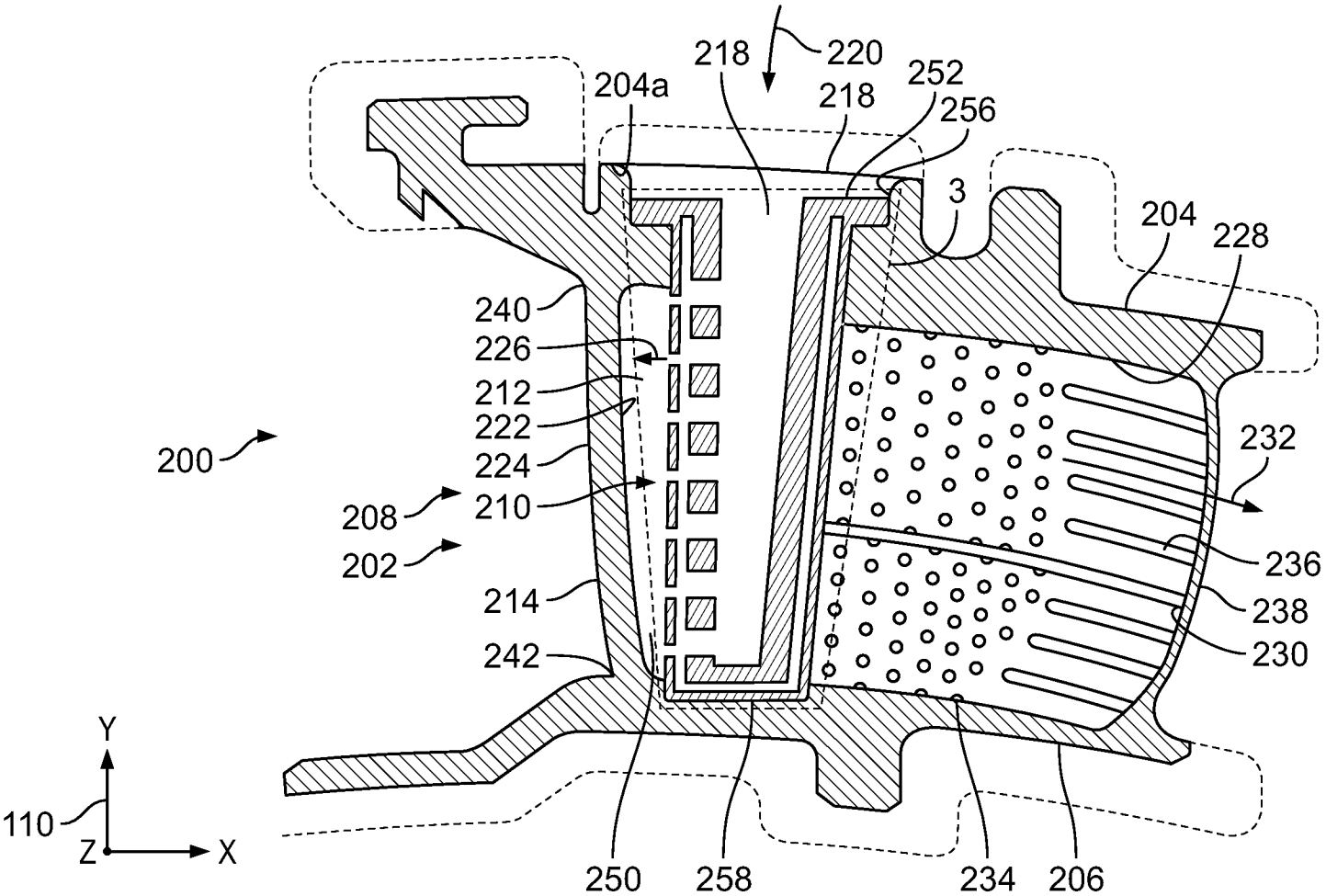
FIG. 2 is a cross-sectional view of the turbine vane airfoil of FIG. 1A, taken at line 2-2 of FIG. 1A, which illustrates an impingement tube associated with the turbine vane airfoil that provides dust tolerant impingement cooling for the turbine vane airfoil, and thus, the turbine nozzle.
Figure 2A:
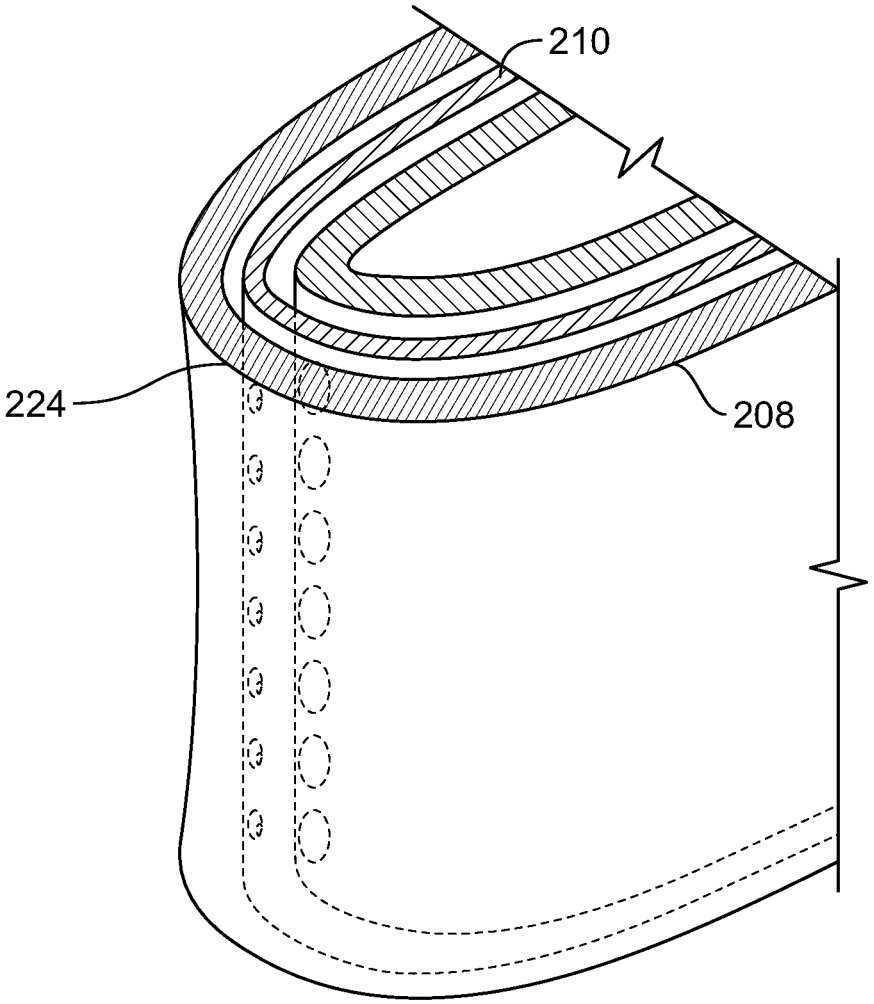
FIG. 2A is a front perspective view of the turbine vane airfoil including the impingement tube.

Referring to FIGS. 1A and 2, the impingement tube 210 is used to cool the airfoil 208 of the turbine vane airfoil 202 during operation of the gas turbine engine 100. The impingement tube 210 supports enhanced convective heat removal targeted at a leading edge portion 214 of the airfoil 208, which is primarily impinged by the combustive gas flow discharged from combustor 102 (represented by arrows 216). During operation of the gas turbine engine 100, a secondary flow system directs relatively cool airflow or cooling fluid 220 into an outboard portion 218 of the impingement tube 210. Thus, generally, a flow direction of the cooling fluid 220 into the impingement tube 210 is in the radial direction. The cooling fluid 220 flows through the impingement tube 210 and exits the impingement tube 210 to provide cooling to the leading edge portion 214 of the airfoil 208 (FIG. 2A). With continued reference to FIG. 2A, when the impingement tube 210 is positioned within the airfoil 208, the impingement tube 210 directs cooling impingement jets against an interior surface or surface 222 of the leading edge portion 214 of the airfoil 208. The surface 222 is opposite a leading edge 224 of the airfoil 208. An exemplary cooling impingement jet is represented by arrow 226 in FIG. 2.

Figure 2B:
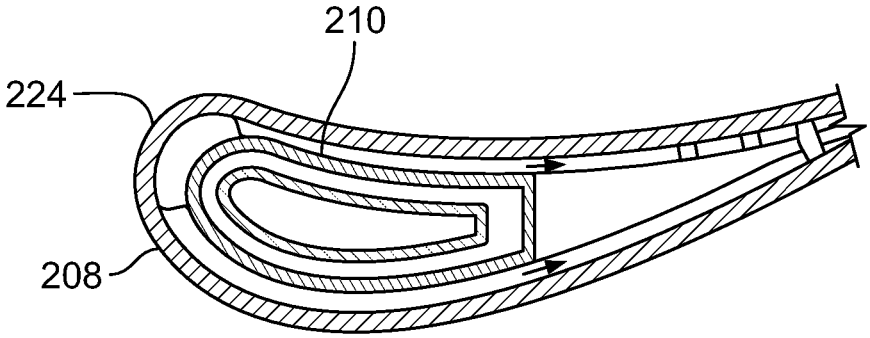
FIG. 2B is a cross-sectional view, taken along line 2B-2B of FIG. 1A, which illustrates the turbine vane airfoil including the impingement tube.

With reference to FIG. 2B, after impingement against the surface 222 of the leading edge portion 214 of the airfoil 208, the cooling fluid 220 is conducted along an interior 228 of the airfoil 208 and exits the airfoil 208 through a trailing outlet 230, as further indicated in FIG. 2B by arrow 232. In various embodiments, the cooling fluid 220 may additionally exit via film holes 234. With reference to FIG. 2, the interior 228 of the airfoil 208 may include flow directing structures 236, such as ribs, pins, etc. to assist in directing the cooling airflow to the trailing outlet 230. The trailing outlet 230 is defined at a trailing edge 238 of the airfoil 208. The trailing edge 238 is substantially opposite the leading edge 224 in a chordwise direction or the axial direction. A tip 240 of the airfoil 208 is coupled to the outer annular endwall 204, and a root 242 of the airfoil 208 is coupled to the inner annular endwall 206. The tip 240 is opposite the root 242 in a spanwise direction or the radial direction.

Generally, the impingement tube 210 may be shaped and dimensioned such that a peripheral clearance 250 is provided between impingement tube 210, the surface 222 and the interior 228 of the airfoil 208. The peripheral clearance 250 allows the cooling air to flow around the impingement tube 210 and along the interior 228 of the airfoil 208 for additional convective cooling (FIG. 2B). The impingement tube 210 may be coupled to the internal chamber 212 via a press fit, for example, however, the impingement tube 210 may be coupled to the airfoil 208 in another manner, such as by bonding, welding or with fasteners. In certain embodiments, the impingement tube 210 may include a peripheral flange 252 or other peripheral projections, such as one or more tabs, which extend from outboard portion 218 of the impingement tube 210. When the impingement tube 210 is coupled to and inserted into the airfoil 208, the peripheral flange 252 may seat against a mating surface 256 defined by an exterior 204*a* of the outer annular endwall 204 to further couple the impingement tube 210 to the airfoil 208.

Figure 3:
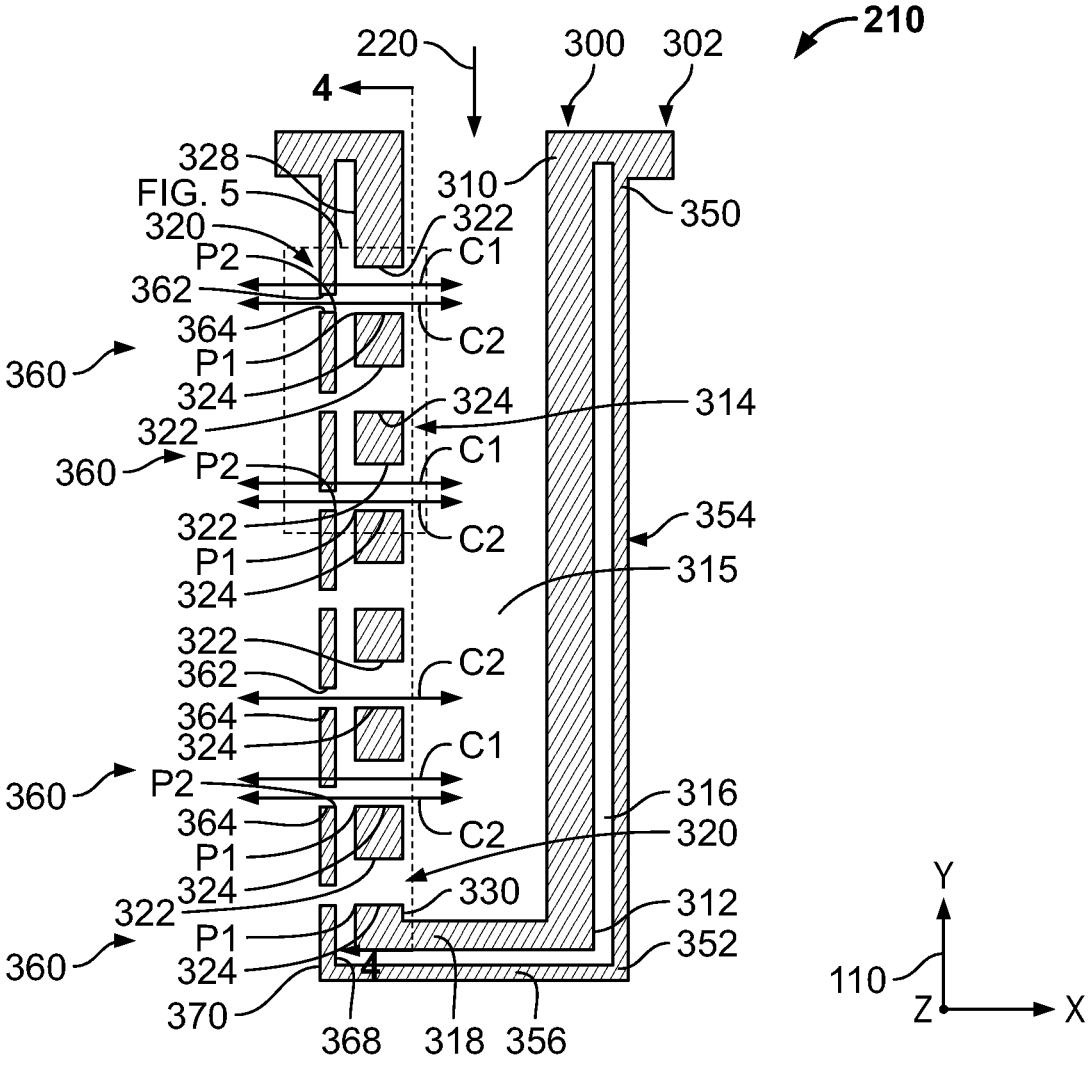
FIG. 3 is a detail cross-sectional view of the impingement tube of FIG. 2 taken at 3 on FIG. 2.

With reference to FIG. 3, the impingement tube 210 is shown in greater detail. In this example, the impingement tube 210 is a double-wall impingement tube, and includes an inner, first tube body 300 and an outer, second tube body 302. In one example, the impingement tube 210 is composed of metal or metal alloy, and is cast, formed, and machined, additively manufactured via direct metal laser sintering (DMLS), etc. In this example, the first tube body 300 and the second tube body 302 are integrally formed via additive manufacturing, including, but not limited to DMLS, but it should be noted that the first tube body 300 and the second tube body 302 may be formed discretely and coupled together via welding, adhesives, press-fit, mechanical fasteners, etc. In addition, it should be noted that while the impingement tube 210 is shown and described herein as being discretely formed or separate from the airfoil 208, in other embodiments, the impingement tube 210 may be integrally formed with, one-piece or monolithic with the airfoil 208. The first tube body 300 is an inner tube of the impingement tube 210, while the second tube body 302 is an outer tube of the impingement tube 210. The second tube body 302 is positioned between the first tube body 300 and the surface 222 (FIG. 2).

The first tube body 300 includes a first body end 310 opposite a second body end 312 in the radial direction. A plurality of first walls 314 couple or interconnect the first body end 310 with the second body end 312 to define a substantially elongated hollow tube. The first body end 310 is at the outboard portion 218 of the impingement tube 210, and the second body end 312 is proximate an inboard end 258 of the airfoil 208 (FIG. 2). The first body end 310 is open about its perimeter to enable the secondary cooling flow to enter into the first tube body 300 and flow to the second body end 312. Thus, the first body end 310 is an upstream end of the first tube body 300, and the second body end 312 is a downstream end of the first tube body 300 in a flow direction of the cooling fluid 220. In this example, the first body end 310 is integrally formed with the second tube body 302, while the second body end 312 is spaced apart from and uncoupled from the second tube body 302 to define a tube chamber 316 between the first tube body 300 and the second tube body 302. In the event that one or more of the first apertures 320 of the first tube body 300 plug with particulates, such as fine sand and/or dust, the tube chamber 316 enables cooling flow to still supply some cooling air to the respective second apertures 360 of the second tube body 302 to cool the interior surface 222 of the leading edge 224. The second body end 312 is closed at its perimeter or defines a planar surface 318, which encloses or interconnects the first walls 314 at the second body end 312 and directs the cooling fluid toward the first walls 314.

The first walls 314 extend about the perimeter of the first tube body 300 and enclose the perimeter of the first tube body 300 to define a tube plenum 315. The first walls 314 are each substantially planar or flat, but in certain examples, one or more of the first walls 314 may be curved or arcuate to correspond with a shape of the internal chamber 212 of the airfoil 208 (FIG. 2B). One or more of the first walls 314 defines a plurality of first apertures 320. In this example, the first tube body 300 is illustrated with one first wall 314 defining the first apertures 320, but it should be understood that each first wall 314 of the first tube body 300 may define the first apertures 320. In one example, the first wall 314 defines seven first apertures 320 that are spaced apart along the first wall 314, however, the first wall 314 may define any number of first apertures 320 from about one to about 30. Each of the first apertures 320 has a first upstream surface portion 322 opposite a first downstream surface portion 324 in the flow direction of the cooling fluid 220 into the impingement tube 210.

Figure 4:
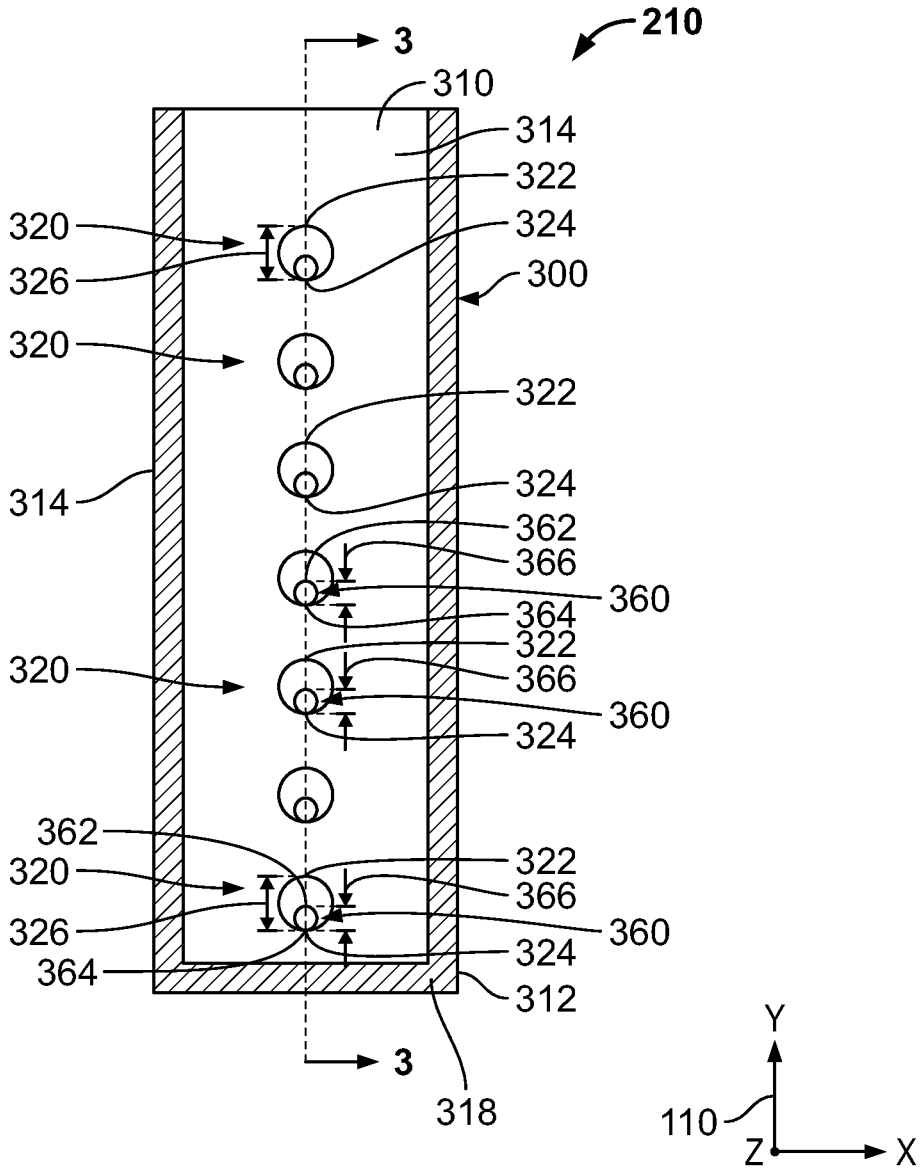
FIG. 4 is a cross-sectional view of the impingement tube of FIG. 3, taken at line 4-4 of FIG. 3, which illustrates an exemplary arrangement of a plurality of first apertures and a plurality of second apertures.

With reference to FIG. 4, each of the first apertures 320 has a first geometry, which is circular. Each of the first apertures 320 also has a first dimension 326 defined between the first upstream surface portion 322 and the first downstream surface portion 324. In this example, the first dimension 326 is a first diameter. The first dimension 326 is about 0.020 inches (in.) to about 0.100 inches (in.), however, the first dimension 326 may vary based on a length of the first tube body 300 in the radial direction. With reference back to FIG. 3, each of the first apertures 320 also has a first centerline C1. The first centerline C1 is substantially parallel to the axial direction. The first downstream surface portion 324 of at least one of the first apertures 320 also includes a first point P1. In this example, the first point P1 is defined at an exterior surface 328 of the first wall 314 that defines the first apertures 320. The exterior surface 328 faces the second tube body 302. The exterior surface 328 is opposite an interior surface 330 of the first tube body 300. The interior surface 330 is disposed within the tube plenum 315.

The second tube body 302 includes a third body end 350 opposite a fourth body end 352 in the radial direction. A plurality of second walls 354 couple or interconnect the third body end 350 with the fourth body end 352 to define a substantially elongated hollow tube. The third body end 350 is at the outboard portion 218 of the impingement tube 210, and the fourth body end 352 is at the inboard end 258 of the airfoil 208 (FIG. 2). The third body end 350 interconnects the second tube body 302 to the first body end 310. The third body end 350 is closed such that the cooling fluid within the tube chamber 316 is inhibited from exiting through the third body end 350. The third body end 350 is an upstream end of the second tube body 302, and the fourth body end 352 is a downstream end of the second tube body 302 in the flow direction of the cooling fluid 220 into the impingement tube 210. The fourth body end 352 is closed at is perimeter or defines a planar surface 356, which encloses or interconnects the second walls 354 at the fourth body end 352.

The second walls 354 extend about the perimeter of the second tube body 302 and enclose the perimeter of the second tube body 302 to surround the tube chamber 316. The tube chamber 316 is defined between the first tube body 300 and the second tube body 302 so as to extend between the walls 314, 354, the second body end 312 and the fourth body end 352. Thus, the second walls 354 are spaced apart from the first walls 314. The first walls 314 form an inner wall of the impingement tube 210, while the second walls 354 form an outer wall of the impingement tube 210. The second walls 354 are each substantially planar or flat, but in certain examples, one or more of the second walls 354 may be curved or arcuate to correspond with a shape of the internal chamber 212 of the airfoil 208 (FIG. 2). One or more of the second walls 354 defines a plurality of second apertures 360. In this example, the second tube body 302 is illustrated with one second wall 354 defining the second apertures 360, but it should be understood that each second wall 354 of the second tube body 302 may define the second apertures 360. The second wall 354 is positioned between the first wall 314 and the surface 222 (FIG. 2). In one example, the second wall 354 defines seven second apertures 360 that are spaced apart along the second wall 354, however, the second wall 354 may define any number of second apertures 360 from about one to about 30 that corresponds with the number of first apertures 320. Each of the second apertures 360 has a second upstream surface portion 362 opposite a second downstream surface portion 364 in the flow direction of the cooling fluid 220 into the impingement tube 210.

With reference to FIG. 4, in this example, each of the second apertures 360 has a second geometry, which is circular. Each of the second apertures 360 also has a second dimension 366 defined between the second upstream surface portion 362 and the second downstream surface portion 364. In this example, the second dimension 366 is a second diameter. The second dimension 366 is about 0.015 inches (in.) to about 0.075 inches (in.), however, the second dimension 366 may vary based on a length of the second tube body 302 in the radial direction. In this example, the first dimension 326 is different, and greater than, the second dimension 366.

With reference back to FIG. 3, each of the second apertures 360 also has a second centerline C2. The second centerline C2 is substantially parallel to the axial direction. The first centerline C1 is offset from or not collinear with the second centerline C2, but the second centerline C2 is substantially parallel to the first centerline C1. The second downstream surface portion 364 of at least one of the second apertures 360 also includes a second point P2. In this example, the second point P2 is defined at an interior surface 368 of the second wall 354 that defines the second apertures 360. The interior surface 368 faces the first tube body 300, and is opposite an exterior surface 370 of the second tube body 302. The exterior surface 370 faces the surface 222 of the leading edge 224 (FIG. 2).

Figure 5:
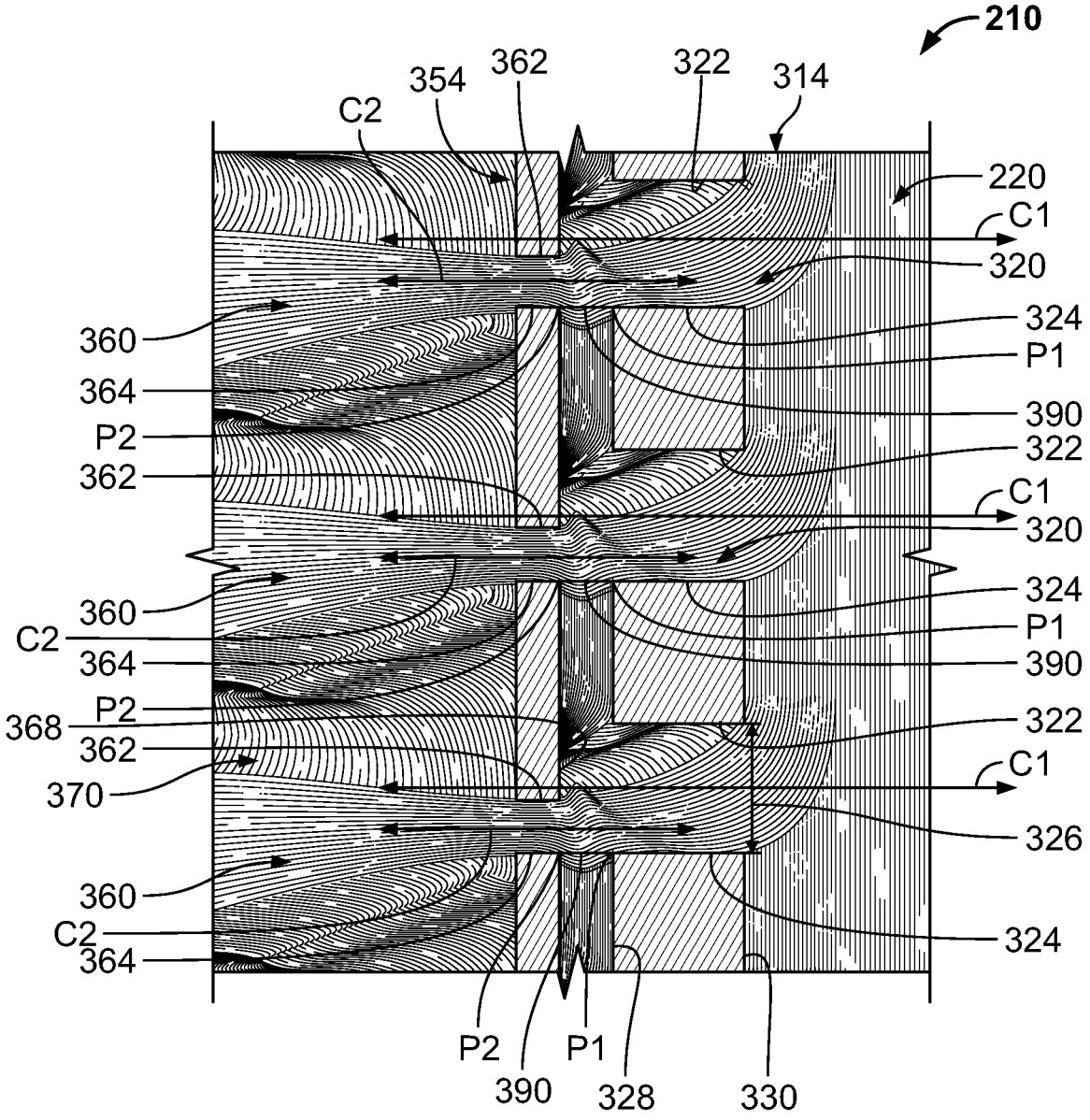
FIG. 5 is a detail environmental cross-sectional view of the impingement tube of FIG. 3 taken at 5 on FIG. 3, which illustrates a flow of a cooling fluid through the plurality of first apertures and the plurality of second apertures.

Each of the first apertures 320 cooperate with a respective one of the second apertures 360 to direct the cooling fluid 220 onto the surface 222 (FIG. 2). With reference to FIG. 5, a detail view of a portion of the impingement tube 210 is shown. The first point P1 of each of the first apertures 320 is collinear with the second point P2 of the respective one of the second apertures 360 along a line 390. Each line 390 is substantially parallel to the first centerline C1 of the respective one of the first apertures 320, and is substantially parallel to the second centerline C2 of the respective one of the second apertures 360. By aligning the points P1, P2 collinear along the line 390, the fine sand and dust particles are aligned to pass through the second apertures 360, which reduces the accumulation of the particles or particulates (fine sand and dust) within the impingement tube 210. In addition, by aligning the points P1, P2 collinear along the line 390, a lensing affect is created as the flow through the first apertures 320 is not concentrated along the centerline C1, but rather, is concentrated along the first downstream surface portion 324, as shown in FIG. 5. In addition, the larger first dimension 326 of the first apertures 320 acts to accelerate and align particles, such as fine sand and dust, which directs the particles out of the impingement tube 210, thereby reducing a plugging of the impingement tube 210 or an accumulation of the particles within the impingement tube 210. In addition, the acceleration of the cooling fluid 220 by the first apertures 320 increases a velocity of the cooling fluid 220, which further reduces the accumulation of fine sand and dust particles within the impingement tube 210.

Larger fine sand and dust particles that cannot maintain alignment with the flow of the cooling fluid 220 through the first apertures 320 and the second apertures 360 bounce off the surface 318 and are deflected through the first apertures 320 and the second apertures 360, which further reduces the accumulation within the impingement tube 210. By aligning the points P1, P2 collinear along the line 390, particulates are less likely to stick on the entrance of the second apertures 360 at the second upstream surface portion 362 or on the second downstream surface portion 364. Less accumulation of particulates results in more robust impingement cooling of the interior surface 222.

Figure 5A:
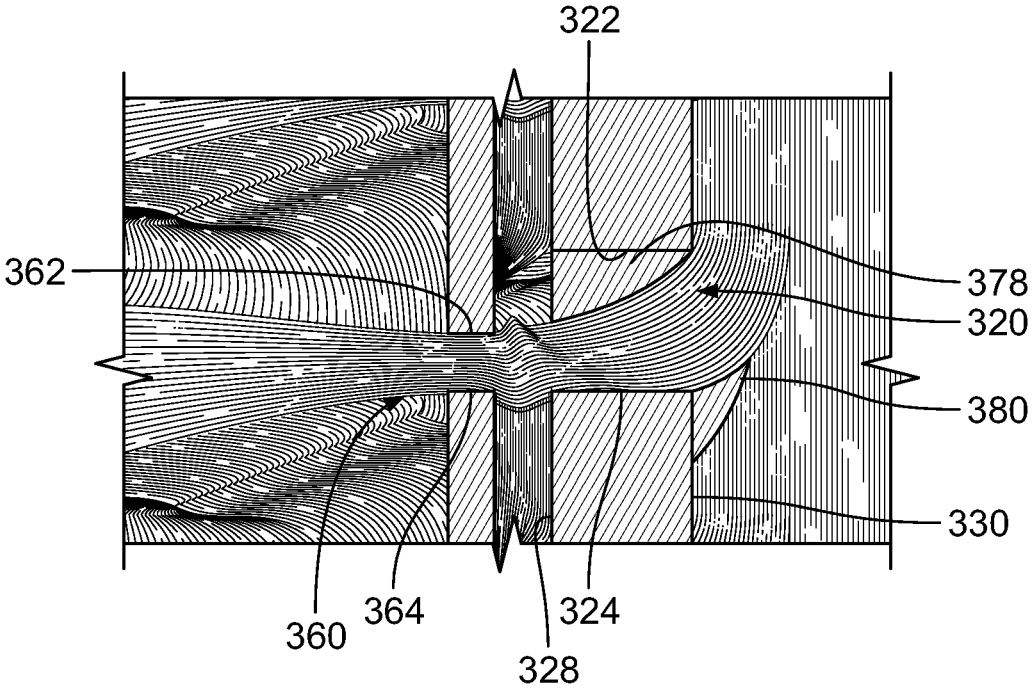
FIG. 5A is a detail environmental cross-sectional view of the impingement tube of FIG. 3 taken from the perspective of 5 on FIG. 3, which illustrates the flow of a cooling fluid through the plurality of first apertures and the plurality of second apertures in an example where each of the plurality of first apertures include a flow guide and a projection.
Figure 5B:
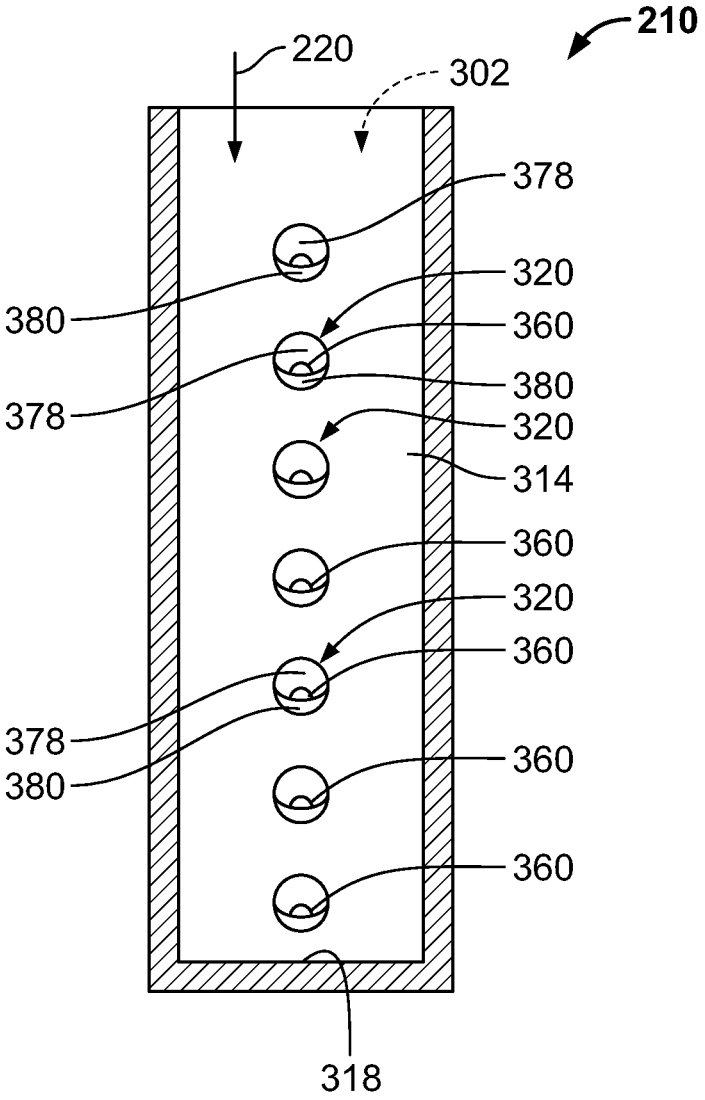
FIG. 5B is a cross-sectional view of the impingement tube of FIG. 3, taken from the perspective of line 4-4 of FIG. 3, which illustrates the plurality of first apertures and the plurality of second apertures in the example where each of the plurality of first apertures include the flow guide and the projection.
Figure 6:
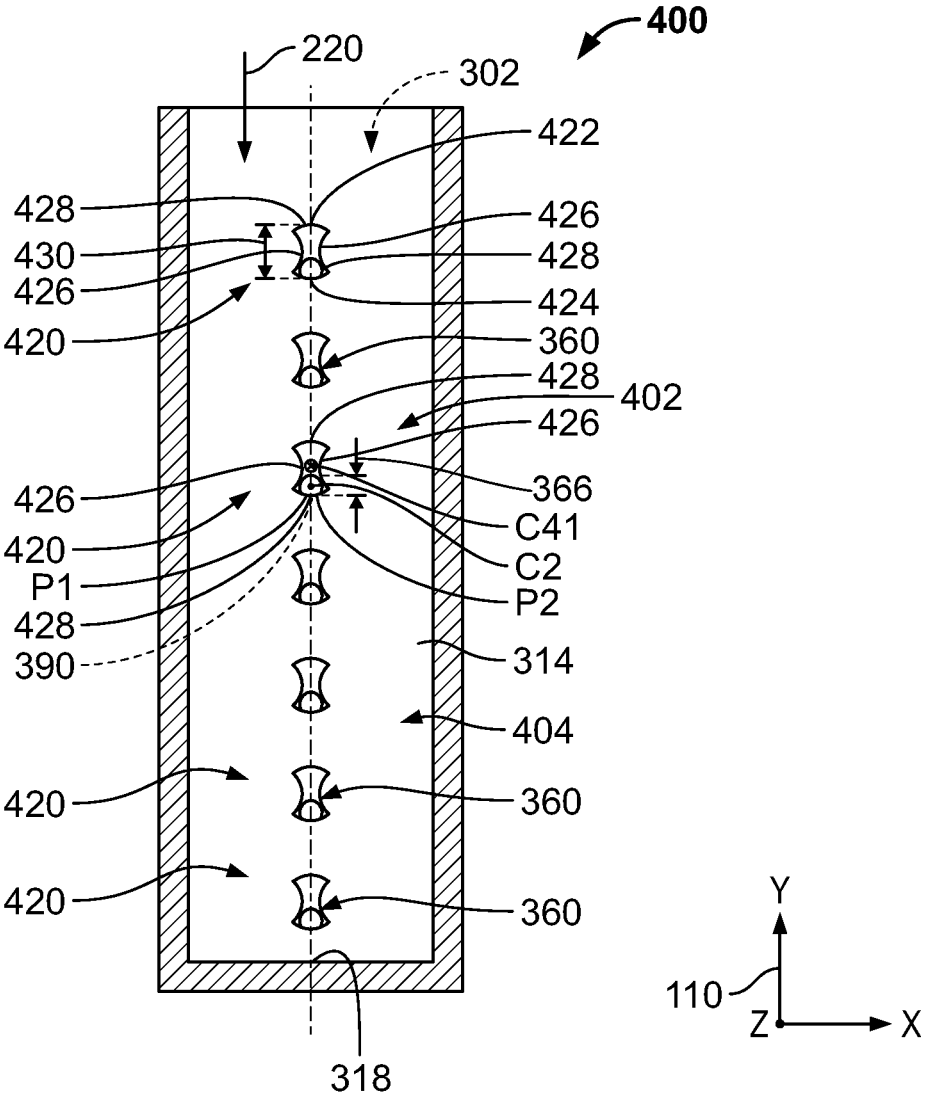
FIG. 6 is a cross-sectional view of another exemplary impingement tube, taken from the perspective of line 4-4 of FIG. 3, which illustrates another exemplary arrangement of a plurality of first apertures and the plurality of second apertures.
Figure 7:
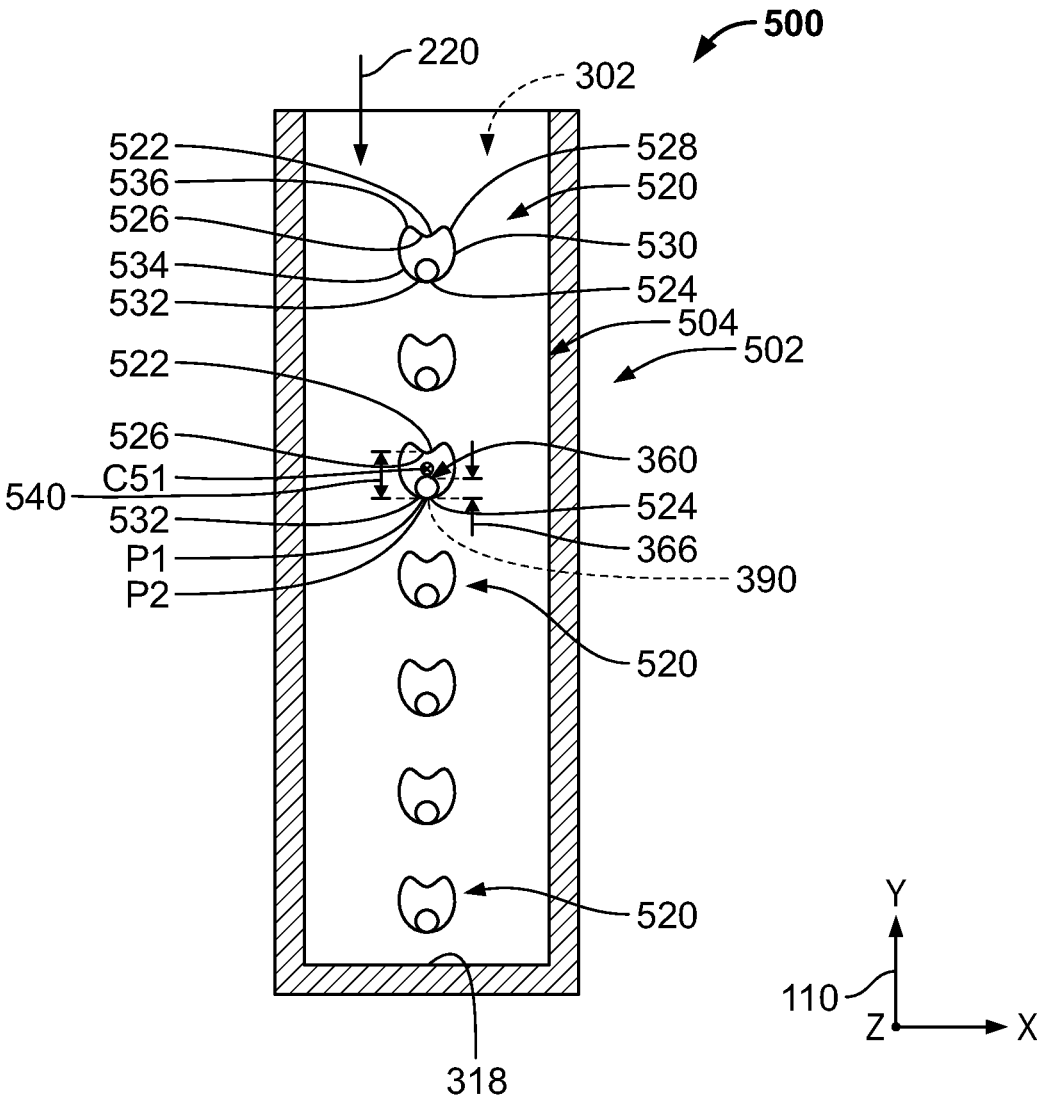
FIG. 7 is a cross-sectional view of another exemplary impingement tube, taken from the perspective of line 4-4 of FIG. 3, which illustrates another exemplary arrangement of a plurality of first apertures and the plurality of second apertures.
Figure 8:
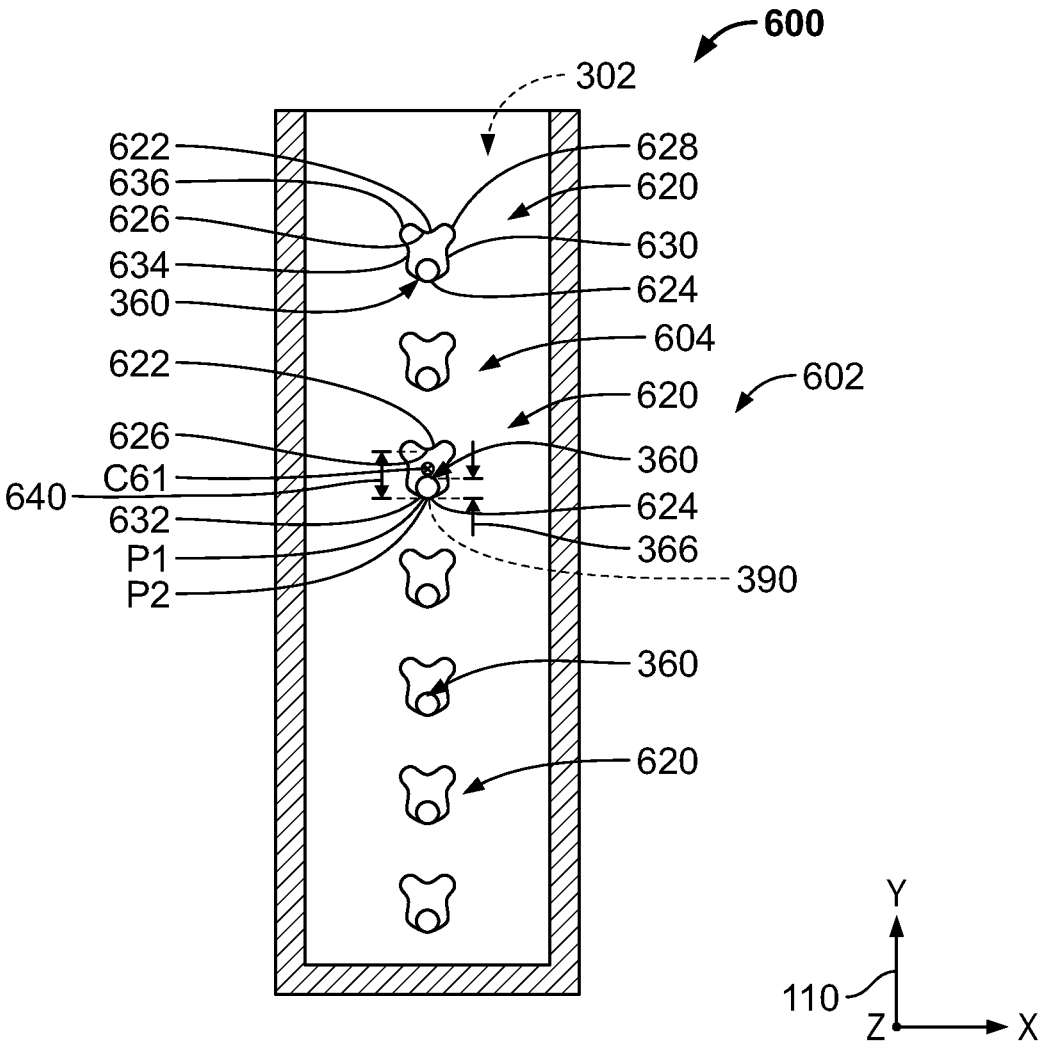
FIG. 8 is a cross-sectional view of another exemplary impingement tube, taken from the perspective of line 4-4 of FIG. 3, which illustrates another exemplary arrangement of a plurality of first apertures and the plurality of second apertures.

In this example, each of the first apertures 320 is the same. It should be noted that in other examples, each of the first apertures 320 may have a different geometry or dimension. In addition, in certain embodiments, one or more of the first apertures 320 may have flow directing channels to reduce a stagnation region defined proximate the first upstream surface portion 322. In this regard, with reference to FIGS. 5A and 5B, each of the first apertures 320 may include a respective flow guide 378 and/or the interior surface 330 of the first tube body 300 may define a respective projection 380. Each of the flow guides 378 extend into each of the first apertures 320 (FIG. 5B) and cooperate with the respective first aperture 320 to taper each of the first apertures 320 from the interior surface 330 to the exterior surface 328 of the first wall 314. The taper defined by the flow guides 378 substantially eliminates a stagnation region within the respective first aperture 320, while also directing the flow into the respective second aperture 360. The projections 380 extend outwardly from the interior surface 330 proximate the first downstream surface portion 324 of the respective first aperture 320 and project above the first downstream surface portion 324 to inhibit buildup at a stagnation point defined proximate the first downstream surface portion 324. The projections 380 also help funnel or guide the cooling flow into the respective first apertures 320 with minimal particulate accumulation on the interior surface 330 of the first tube body 300 proximate the first upstream surface portion 322 and first downstream surface portion 324.

Further, while the first apertures 320 and the second apertures 360 are described in FIGS. 1-5 as having the same geometry, in other embodiments, the first apertures 320 may have a different geometry than the second apertures 360 to direct the cooling fluid onto the surface 222 (FIG. 1). For example, with reference to FIG. 6, a first wall 404 of a first tube body 402 associated with an impingement tube 400 is shown. As the impingement tube 400 includes components that are substantially similar to or the same as the impingement tube 210 discussed with regard to FIGS. 1-5B, the same reference numerals will be used to denote the same or similar features. The first wall 404 defines a plurality of first apertures 420. In one example, the first wall 404 defines seven first apertures 420 that are spaced apart along the first wall 404, however, the first wall 404 may define any number of first apertures 420 from about one to about 30. Each of the first apertures 420 has a first upstream surface portion 422 opposite a first downstream surface portion 424 in the flow direction of the cooling fluid 220 into the impingement tube 400.

In this example, each of the first apertures 420 has a second geometry, which includes a pair of concave surfaces 426 and a pair of convex surfaces 428. The concave surfaces 426 are opposite each other, and interconnected by a respective one of the convex surfaces 428. Thus, in this example, each of the first apertures 420 has a first geometry that is different than the second geometry of each of the second apertures 360. Each of the first apertures 420 also has a first dimension 430 defined between the first upstream surface portion 422 and the first downstream surface portion 424. In this example, the first dimension 430 is a distance, which is the same as the first dimension 326. Each of the first apertures 420 also has a first centerline C41. The first centerline C41 is substantially parallel to the axial direction. The first centerline C41 is offset from or non-collinear with the second centerline C2. The first downstream surface portion 424 of at least one of the first apertures 420 also includes the first point P1.

Each of the first apertures 420 cooperate with a respective one of the second apertures 360 to direct the cooling fluid onto the surface 222 (FIG. 2). The first point P1 of each of the first apertures 420 is collinear with the second point P2 of the respective one of the second apertures 360 along the line 390. Each line 390 is substantially parallel to the first centerline C41 of the respective one of the first apertures 420, and is substantially parallel to the second centerline C2 of the respective one of the second apertures 360. By aligning the points P1, P2 collinear along the line 390, the fine sand and dust particles are aligned to pass through the second apertures 360, which reduces the accumulation of the particles (fine sand and dust) within the impingement tube 400. By shaping the first apertures 420 to include the concave surfaces 426, the shape of the first apertures 420 reduces a stagnation region associated with the circular first apertures 320. The concave surfaces 426 also assist in accelerating the flow through the first apertures 420 and in directing the flow through the respective second apertures 360 with minimal particulate accumulation on the surfaces of the apertures 420, 360.

In addition, while the first apertures 320 and the second apertures 360 are described in FIGS. 1-5 as having the same geometry, in other embodiments, the first apertures 320 may have a different geometry than the second apertures 360 to direct the cooling fluid onto the surface 222 (FIG. 1). For example, with reference to FIG. 7, a first wall 504 of a first tube body 502 associated with an impingement tube 500 is shown. As the impingement tube 500 includes components that are substantially similar to or the same as the impingement tube 210 discussed with regard to FIGS. 1-5B, the same reference numerals will be used to denote the same or similar features. The first wall 504 defines a plurality of first apertures 520. In one example, the first wall 504 defines seven first apertures 520 that are spaced apart along the first wall 504, however, the first wall 504 may define any number of first apertures 520 from about one to about 30. Each of the first apertures 520 has a first upstream surface portion 522 opposite a first downstream surface portion 524 in the flow direction of the cooling fluid 220 into the impingement tube 500.

In this example, each of the first apertures 520 has a second geometry, which includes a first concave surface 526, a first convex surface 528, a first arcuate surface 530, a second convex surface 532, a second arcuate surface 534 and a third convex surface 536. The first concave surface 526 is defined along the first upstream surface portion 522. The first concave surface 526 is interconnected with the first convex surface 528 and the third convex surface 536. The first convex surface 528 is defined along the first upstream surface portion 522. The first convex surface 528 interconnects the first concave surface 526 and the first arcuate surface 530. The first arcuate surface 530 defines a sidewall of each of the first apertures 520, and interconnects the first upstream surface portion 522 with the first downstream surface portion 524. The first arcuate surface 530 interconnects the first convex surface 528 and the second convex surface 532. The second convex surface 532 is defined along the first downstream surface portion 524. The second arcuate surface 534 defines another sidewall of each of the first apertures 520, and interconnects the first downstream surface portion 524 with the first upstream surface portion 522. The second arcuate surface 534 interconnects the second convex surface 532 and the third convex surface 536. The first arcuate surface 530 and the second arcuate surface 534 are opposite and form opposing sidewalls of each of the first apertures 520. The third convex surface 536 interconnects the second arcuate surface 534 and the first concave surface 526. The third convex surface 536 is defined along the first upstream surface portion 522. Thus, in this example, each of the first apertures 520 has a first geometry that is different than the second geometry of each of the second apertures 360. Each of the first apertures 520 also has a first dimension 540 defined between the first concave surface 526 of the first upstream surface portion 522 and the second convex surface 532 of the first downstream surface portion 524. In this example, the first dimension 540 is a distance, which is the same as the first dimension 326. Each of the first apertures 520 also has a first centerline C51. The first centerline C51 is substantially parallel to the axial direction. The first centerline C51 is offset from or non-collinear with the second centerline C2. The first downstream surface portion 524 of at least one of the first apertures 520 also includes the first point P1.

Each of the first apertures 520 cooperate with a respective one of the second apertures 360 to direct the cooling fluid onto the surface 222 (FIG. 2). The first point P1 of each of the first apertures 520 is collinear with the second point P2 of the respective one of the second apertures 360 along the line 390. Each line 390 is substantially parallel to the first centerline C51 of the respective one of the first apertures 520, and is substantially parallel to the second centerline C2 of the respective one of the second apertures 360. By aligning the points P1, P2 collinear along the line 390, the fine sand and dust particles are aligned to pass through the second apertures 360, which reduces the accumulation of the particles (fine sand and dust) within the impingement tube 500. By shaping the first apertures 520 to include the convex surfaces 528, 532, 536, the shape of the first apertures 520 reduces a stagnation region associated with the circular first apertures 320 and the convex surfaces 528, 532, 536 assist in accelerating the flow through the first apertures 520 and into the respective second apertures 360. The result is that the combination of convex and concave surfaces in the first apertures 520 assist in accelerating the flow through the first apertures 520 and in directing the flow through the respective second apertures 360 with minimal particulate accumulation on the surfaces of the apertures 520, 360.

While the first apertures 320 and the second apertures 360 are described in FIGS. 1-5 as having the same geometry, in other embodiments, the first apertures 320 may have a different geometry than the second apertures 360 to direct the cooling fluid onto the surface 222 (FIG. 1). For example, with reference to FIG. 8, a first wall 604 of a first tube body 602 associated with an impingement tube 600 is shown. As the impingement tube 600 includes components that are substantially similar to or the same as the impingement tube 210 discussed with regard to FIGS. 1-5B, the same reference numerals will be used to denote the same or similar features. The first wall 604 defines a plurality of first apertures 620. In one example, the first wall 604 defines seven first apertures 620 that are spaced apart along the first wall 604, however, the first wall 604 may define any number of first apertures 620 from about one to about 30. Each of the first apertures 620 has a first upstream surface portion 622 opposite a first downstream surface portion 624 in the flow direction of the cooling fluid 220 into the impingement tube 600.

In this example, each of the first apertures 620 has a second geometry, which includes a first concave surface 626, a first convex surface 628, a second concave surface 630, a second convex surface 632, a third concave surface 634 and a third convex surface 636. The first concave surface 626 is defined along the first upstream surface portion 622. The first concave surface 626 is interconnected with the first convex surface 628 and the third convex surface 636. The first convex surface 628 is defined along the first upstream surface portion 622. The first convex surface 628 interconnects the first concave surface 626 and the second concave surface 630. The second concave surface 630 defines a sidewall of each of the first apertures 620, and interconnects the first upstream surface portion 622 with the first downstream surface portion 624. The second concave surface 630 interconnects the first convex surface 628 and the second convex surface 632. The second convex surface 632 is defined along the first downstream surface portion 624. The third concave surface 634 defines another sidewall of each of the first apertures 620, and interconnects the first downstream surface portion 624 with the first upstream surface portion 622. The second concave surface 630 and the third concave surface 634 are opposite and form opposing sidewalls of each of the first apertures 620. The third concave surface 634 interconnects the second convex surface 632 and the third convex surface 636. The third convex surface 636 interconnects the third concave surface 634 and the first concave surface 626. The third convex surface 636 is defined along the first upstream surface portion 622. Thus, in this example, each of the first apertures 620 has a first geometry that is different than the second geometry of each of the second apertures 360. Each of the first apertures 620 also has a first dimension 640 defined between the first concave surface 626 of the first upstream surface portion 622 and the second convex surface 632 of the first downstream surface portion 624. In this example, the first dimension 640 is a distance, which is the same as the first dimension 326. Each of the first apertures 620 also has a first centerline C61. The first centerline C61 is substantially parallel to the axial direction. The first centerline C61 is offset from or non-collinear with the second centerline C2. The first downstream surface portion 624 of at least one of the first apertures 620 also includes the first point P1.

Each of the first apertures 620 cooperate with a respective one of the second apertures 360 to direct the cooling fluid onto the surface 222 (FIG. 2). The first point P1 of each of the first apertures 620 is collinear with the second point P2 of the respective one of the second apertures 360 along the line 390. Each line 390 is substantially parallel to the first centerline C61 of the respective one of the first apertures 620, and is substantially parallel to the second centerline C2 of the respective one of the second apertures 360. By aligning the points P1, P2 collinear along the line 390, the fine sand and dust particles are aligned to pass through the second apertures 360, which reduces the accumulation of the particles (fine sand and dust) within the impingement tube 600. By shaping the first apertures 620 to include the concave surfaces 630, 634, the shape of the first apertures 620 reduces a stagnation region associated with the circular first apertures 320 and the concave surfaces 630, 634 assist in accelerating the flow through the first apertures 620 and into the respective second apertures 360. The result is that the combination of convex and concave surfaces in the first apertures 620 assist in accelerating the flow through the first apertures 620 and in directing the flow through the respective second apertures 360 with minimal particulate accumulation on the surfaces of the apertures 620, 360.

In addition, it should be noted that while the first apertures 320, 420, 520, 620 have been illustrated herein as having the same hole shape defined along the respective first wall 314, 404, 504, 604, in other embodiments, a first wall may include a variety of hole shapes, such as a combination of one or more of the first apertures 320, 420, 520, 620. Moreover, while the first apertures 320, 420, 520, 620 and the second apertures 360 have been described and illustrated herein as having the same first dimension 326, 430, 540, 640, in other embodiments, one or more of the first apertures 320, 420, 520, 620 and the second apertures 360 may have a different dimension along the respective wall 314, 404, 504, 604, 354 such that on the respective wall 314, 404, 504, 604, 354 one or more of the first apertures 320, 420, 520, 620 and the second apertures 360 may be larger or smaller than another one of the first apertures 320, 420, 520, 620 and the second apertures 360. In addition, while the first apertures 320, 420, 520, 620 and the second apertures 360 are substantially evenly spaced along the respective wall 314, 404, 504, 604, 354, in other embodiments, the first apertures 320, 420, 520, 620 and/or the second apertures 360 may be unevenly spaced.

In one example, in order to assemble the turbine nozzle 200, with reference to FIGS. 2-4 and 6-8, the impingement tube 210, 400, 500, 600 is formed with the respective first apertures 320, 420, 520, 620 and the second apertures 360, via additive manufacturing, for example. With the turbine vane airfoil 202 formed with the internal chamber 212, the impingement tube 210, 400, 500, 600 is coupled to the internal chamber 212 such that the second wall 354 is positioned adjacent to or proximate the surface 222. The turbine vane airfoil 202 is coupled to the outer annular endwall 204 and the inner annular endwall 206. This process is repeated for the remaining turbine vane airfoils 202 associated with the turbine nozzle 200.

With the turbine nozzle 200 assembled, the turbine nozzle 200 is coupled to the gas turbine engine 100. During operation of the gas turbine engine 100, the hot combustive gases 116 from the combustor 102 flow through the core gas flow path 112 defined in part by the airfoils 208 of the turbine nozzle 200. The cooling fluid 220 flows from the secondary source into the tube plenum 315 defined by the first tube body 300 of the impingement tube 210, 400, 500, 600. The cooling fluid 220, which may include fine sand and dust particles, flows through the first apertures 320, 420, 520, 620. The shape of the first apertures 420, 520, 620 further accelerates the cooling fluid 220 as it flows through the first apertures 420, 520, 620. The cooling fluid 220 exits the first apertures 320, 420, 520, 620 and flows through the second apertures 360. The second apertures 360 direct the cooling fluid 220 as impingement jets onto the surface 222, thereby cooling the surface 222. The cooling fluid 220 flows within the interior 228 of the airfoil 208 to the trailing outlet 230.

Due to the alignment of the first downstream surface portion 324, 424, 524, 624 and the second downstream surface portion 364 along the line 390, the accumulation of fine sand and dust particles within the impingement tube 210, 400, 500, 600 is reduced, which ensures that the first apertures 320, 420, 520, 620 and the second apertures 360 remain clear or unclogged, thereby improving the cooling function of the impingement tube 210, 400, 500, 600. Moreover, by reducing the accumulation of fine sand and dust particles within the impingement tube 210, 400, 500, 600, the life of the turbine vane airfoil 202 and thus, the turbine nozzle 200, is improved, which reduces a downtime associated with the maintenance and/or repair of the gas turbine engine 100.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A turbine vane airfoil for a turbine nozzle, comprising:

an airfoil defining a chamber proximate a surface; and an impingement tube configured to be disposed in the chamber and configured to receive a cooling fluid, the impingement tube discrete from the airfoil, the impingement tube including a first tube body received within a second tube body, with a first wall of the first tube body spaced apart from and opposite a second wall of the second tube body, the first wall defining a plurality of first apertures, each of the plurality of first apertures having a first upstream surface portion opposite a first downstream surface portion in a flow direction of the cooling fluid into the impingement tube, the second wall defining a plurality of second apertures, each of the plurality of second apertures having a second upstream surface portion opposite a second downstream surface portion, at least one of the plurality of first apertures having a first dimension between the first upstream surface portion and the first downstream surface portion that is greater than a second dimension between the second upstream surface portion and the second downstream surface portion of at least one of the plurality of second apertures, each of the plurality of first apertures cooperate with a respective one of the plurality of second apertures to direct the cooling fluid onto the surface, the first downstream surface portion of at least one of the plurality of first apertures includes a first point that is collinear with a second point of the second downstream surface portion of the respective one of the plurality of second apertures along a line and the line is substantially parallel to a first centerline of the at least one of the plurality of first apertures.

2. The turbine vane airfoil of claim 1, wherein the at least one of the plurality of second apertures includes a second centerline, the first centerline is offset from the second centerline and the first centerline is substantially parallel to the second centerline.

3. The turbine vane airfoil of claim 1, wherein each of the plurality of first apertures has a first geometry that is the same as a second geometry of each of the plurality of second apertures.

4. The turbine vane airfoil of claim 1, wherein each of the plurality of first apertures has a first geometry that is different than a second geometry of each of the plurality of second apertures.

5. The turbine vane airfoil of claim 4, wherein at least one of the plurality of first apertures includes at least one convex surface.

6. The turbine vane airfoil of claim 5, wherein the at least one convex surface is defined at the first upstream surface portion.

7. The turbine vane airfoil of claim 5, wherein the at least one convex surface is defined at the first downstream surface portion.

8. The turbine vane airfoil of claim 5, wherein the at least one convex surface includes a pair of convex surfaces, with a first one of the pair of convex surfaces defined at the first upstream surface portion and a second one of the pair of convex surfaces defined at the first downstream surface portion.

9. The turbine vane airfoil of claim 4, wherein at least one of the plurality of first apertures includes at least one concave surface.

10. The turbine vane airfoil of claim 9, wherein the at least one concave surface is defined at the first upstream surface portion.

11. The turbine vane airfoil of claim 4, wherein at least one of the plurality of first apertures further comprises a pair of opposing sidewalls defined by a pair of arcuate surfaces.

12. The turbine vane airfoil of claim 4, wherein at least one of the plurality of first apertures further comprises a pair of opposing sidewalls defined by a pair of concave surfaces.

13. The turbine vane airfoil of claim 1, wherein the first upstream surface portion is defined by at least a concave surface and a convex surface.

14. The turbine vane airfoil of claim 1, wherein the first wall is an inner wall of the impingement tube, the second wall is an outer wall of the impingement tube and the second wall is positioned between the first wall and the surface.

15. The turbine vane airfoil of claim 1, wherein the surface is opposite a leading edge of the airfoil.

16. The turbine vane airfoil of claim 1, wherein the first tube body defines a plenum configured to receive the cooling fluid into the impingement tube, and the first tube body is coupled to the second tube body such that a tube chamber is defined between at least a portion of the first tube body and the second tube body.

17. A turbine nozzle, comprising:

a turbine vane airfoil including an airfoil defining a chamber proximate a surface; and an impingement tube configured to be disposed in the chamber, the impingement tube discrete from the airfoil, the impingement tube including a first tube body including a first wall and a second tube body including a second wall, the first tube body received within the second tube body to define a tube chamber between the first tube body and the second tube body, the first tube body defining a plenum configured to receive a cooling fluid, the first wall spaced apart from and opposite the second wall, the first wall defining a plurality of first apertures, each of the plurality of first apertures having a first upstream surface portion opposite a first downstream surface portion in a flow direction of the cooling fluid into the first tube body, the second wall defining a plurality of second apertures, each of the plurality of second apertures having a second upstream surface portion opposite a second downstream surface portion, at least one of the plurality of first apertures having a first dimension between the first upstream surface portion and the first downstream surface portion that is greater than a second dimension between the second upstream surface portion and the second downstream surface portion of at least one of the plurality of second apertures, each of the plurality of first apertures cooperate with a respective one of the plurality of second apertures to direct the cooling fluid onto the surface, the first downstream surface portion of at least one of the plurality of first apertures includes a first point that is collinear with a second point of the second downstream surface portion of the respective one of the plurality of second apertures along a line and the line is substantially parallel to a first centerline of the at least one of the plurality of first apertures.

18. The turbine nozzle of claim 17, wherein the at least one of the plurality of second apertures includes a second centerline, the first centerline is offset from the second centerline and the first centerline is substantially parallel to the second centerline.

19. The turbine nozzle of claim 17, wherein each of the plurality of first apertures has a first geometry that is different than a second geometry of each of the plurality of second apertures.

20. The turbine nozzle of claim 17, wherein the first wall is an inner wall of the impingement tube, the second wall is an outer wall of the impingement tube, the second wall is positioned between the first wall and the surface, and the surface is opposite a leading edge of the airfoil.

* * * * *